US005133092A

United States Patent [19]

Altinger

[11] Patent Number: 5,133,092

[45] Date of Patent: Jul. 28, 1992

[54] PROTECTIVE SUIT

[76] Inventor: Winfried Altinger, Holderlinstrasse 39, 7530 Pforzheim-8, Fed. Rep. of Germany

[21] Appl. No.: 652,024

[22] Filed: Feb. 8, 1991

[30] Foreign Application Priority Data

Feb. 9, 1990 [DE] Fed. Rep. of Germany ..... 9001479

[51] Int. Cl.[5] ..... A41F 15/00

[52] U.S. Cl. ..... 2/300; 2/310; 2/311; 2/327

[58] Field of Search ..... 2/300, 302, 303, 304, 2/305, 306, 307, 308, 309, 310, 311, 312, 313, 314, 315, 316, 317, 318, 319, 321, 322, 323, 326, 327, 328, 329, 330, 331, 332, 333, 335, 338, 79, 227

[56] References Cited

U.S. PATENT DOCUMENTS

| | | | |
|---|---|---|---|
| 668,118 | 2/1901 | Ostrom | 2/300 |
| 1,245,272 | 11/1917 | Rasmussen | 2/117 X |
| 2,070,016 | 2/1937 | Lipton | 2/300 |
| 2,431,811 | 12/1947 | Lang | 2/79 X |
| 2,503,804 | 4/1950 | Cushman | 2/310 |
| 3,176,793 | 4/1965 | Hlacia | 2/300 |
| 3,220,018 | 11/1965 | Johnson | 2/300 X |
| 3,538,512 | 11/1970 | Polan | 2/227 |
| 3,579,639 | 5/1971 | Faulkner | 2/117 |
| 4,065,814 | 1/1978 | Fox | 2/79 |
| 4,074,364 | 2/1978 | Lucero | 2/117 |
| 4,597,109 | 7/1986 | Hironaga | 2/117 X |
| 4,625,335 | 12/1986 | Vinai | 2/310 X |
| 4,731,882 | 3/1988 | Ekman | 2/79 X |
| 5,036,548 | 8/1991 | Grilliot et al. | 2/79 X |

FOREIGN PATENT DOCUMENTS

| | | | |
|---|---|---|---|
| 214708 | 8/1908 | Fed. Rep. of Germany | 2/117 |
| 607659 | 12/1934 | Fed. Rep. of Germany | 2/117 |
| 1085389 | 2/1955 | France | 2/117 |
| 1350045 | 12/1963 | France | 2/300 |
| 282062 | 4/1952 | Switzerland | 2/117 |

*Primary Examiner*—Werner H. Schroeder
*Assistant Examiner*—Jeanette E. Chapman
*Attorney, Agent, or Firm*—Spensley Horn Jubas & Lubitz

[57] ABSTRACT

A protective suit having a crotch, in combination with a longitudinally adjustable support belt removably connectable to the crotch of the protective suit in such a way that when the suit is being worn the belt extends essentially vertically between the protective suit and the wearer and envelops the body of the wearer.

6 Claims, 1 Drawing Sheet

PROTECTIVE SUIT

BACKGROUND OF THE INVENTION

The present invention relates to a protective suit, for example a one-piece suit for protection against chemicals and/or heat.

As a rule, suits for protection against chemicals as well as heat are manufactured in standard sizes. This has been provided for fire departments, for example, in VFDB [German Association for the Promotion of Fire Prevention] Guidelines 0801 and in DIN 14492, in such a way that a user who is 1.90 m (6'3") tall can wear the respective suit.

Because only a small number of users have this exact size, such a standard suit does not necessarily fit the majority of the users. This has as one result that the crotch of the protective suit will hang down so far that, for example, that activities such as climbing stairs, climbing on tank cars or climbing up ladders become impossible or are performed at best with additional hampering and thus endangerment of the respective user.

It has therefore already been attempted to add a belt at the waist of the protective suit. However, this solution has been only partially effective, because in connection with persons with shorter legs, the crotch area of the protective suit continues to hang too far down, resulting in the hampering and dangers mentioned above.

SUMMARY OF THE INVENTION

It is therefore an object of the present invention to position the protective suit, in particular a one-piece protective suit, with respect to the body of the user in such a way that an exact adaptation of this position to the length of the stride of the respective user can be achieved.

In accordance with the invention, this and other objects are achieved by means of a longitudinally adjustable support belt, which can be removably connected on the inside, at least in the crotch area, with the protective suit in such a way that when being worn it extends essentially vertically within the protective suit and envelops the body of the user.

The essential function of the longitudinally adjustable support belt consists in that it may be adjusted precisely to the actual distance between the shoulders and the crotch of a given user so that the protective suit is fixed in the position set by the adjusted length of the support belt via a connection, for example a loop, between the belt and the suit in the crotch area. In this way the entire length of stride of the user is maintained during the wearing of the protective suit.

In addition to the actually achieved "freedom of the crotch" in spite of the protective suit, the support belt has a considerably expanded function. By means of its "suspension" (for example via a loop) and the routing of the support belt over the two shoulders of the wearer as "resting points", a large portion of the weight of the protective suit itself (which, depending on the design, may have a considerable weight) can be "rerouted" to the shoulders of the user. This is of considerable advantage in particular in connection with those protective suits having a head part with a protective face shield, since in conventional cases practically the entire weight of the protective suit rests on the head of the user, which is uncomfortable and tiring and therefore can diminish his fitness for action. Thus, the protective suit according to the invention with its support belt relieves strain on the head and neck area of the user by absorbing at least a large portion of the weight of the protective suit on the shoulders of the user, thereby eliminating significant hazards to the physical well being of the wearer.

An exemplary embodiment of the protective suit of the invention will be described in detail with reference to the drawings.

DESCRIPTION OF THE PREFERRED EMBODIMENTS

Figure 1:
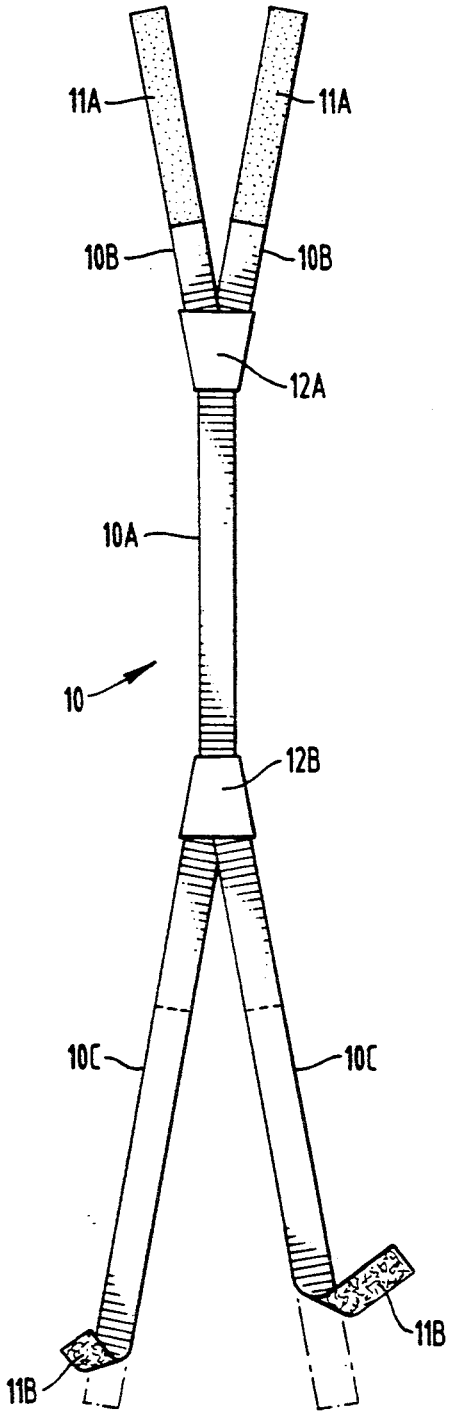
FIG. 1 is an elevational view showing an embodiment of a support belt according to the invention in its flat condition.

FIG. 1 shows the basic structure of a support belt 10 according to a preferred embodiment of the invention. Support belt 10 is made, for example, of pieces of a 50 mm wide and 1.5 mm thick plastic fabric tape, or band, which is highly resistant to tearing and, if required, heat resistant. V-shaped end sections 10B and 10C are connected to a central part 10A via connecting members 12A and 12B, which may be made of the same or a different material and which are simultaneously used for reinforcement.

The two legs of the shorter end section 10B are covered with first layers 11A, the ends of the two legs of the longer end section 10C are provided on their underside with second layers 11B, the materials of layers 11A and 11B being selected to constitute respective members of a hook-and-loop fastener, for example a Velcro TM fastener so that, when each leg of the end section 10C is placed on the associated leg of the end section 10B, they will be secured together via layers 11A and 11B. The function of this support belt 10 will now be described with reference to FIG. 2.

Figure 2:
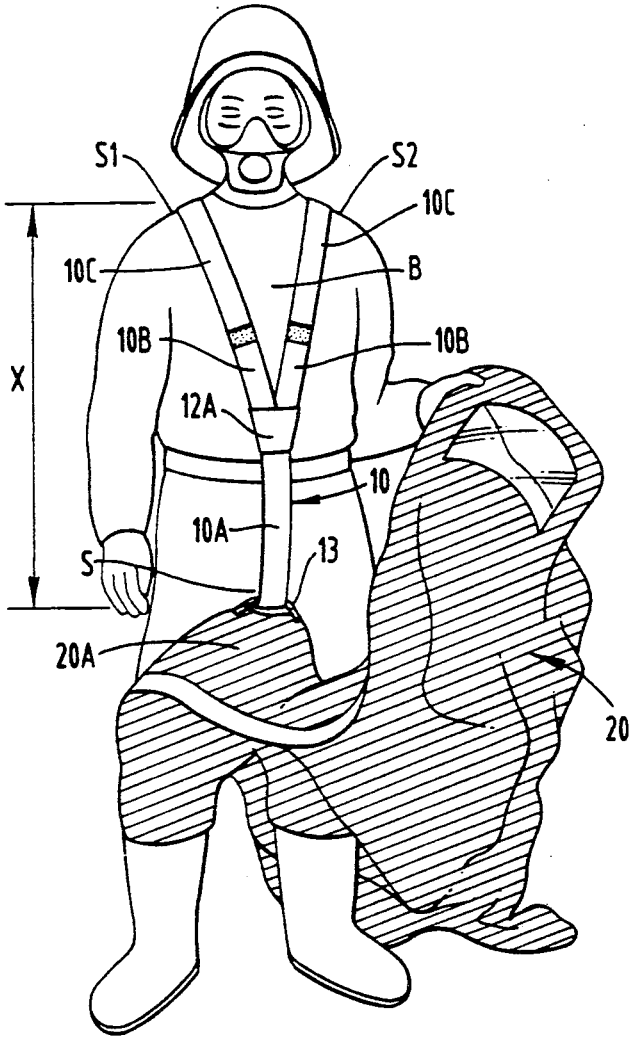
FIG. 2 is a pictorial view showing a protective suit with the support belt of FIG. 1, the support belt having been placed in the desired position on the wearer's body and the suit itself having been partially donned.

The crotch area S of a protective suit 20 is provided with a loop 13 through which the central part 10A of support belt 10 passes. After the user has put on the legs and boots of protective suit 20, as shown in FIG. 2, support belt 10 is put on in such a way that it encircles the body of the user. Specifically, section 10B extends vertically along the chest of the wearer, central part extends down from section 10A, through the crotch and then up the back, and section 10C continues up the back and then over the shoulders to be secured to section 10B. The effective length of support belt 10 and thus the height of the crotch area of the protective suit 20 can be fixed by means of the fastener formed by layers 11A and 11B, which will be located in the chest area B of the wearer. In this way the distance X between the shoulder area S1/S2 and the crotch area S of the wearer is fixed and the correct fit of the suit in the crotch is individually set for each user.

The hook-and-loop fasteners have the advantage that no pressure points are generated, and the belt can be worn comfortably and reused many times. A further advantage can be seen in that any type of protective suit can be retrofitted with the support belt of the invention at any time by the installation of suitable loops or similar fastening elements at the crotch.

This application relates to subject matter disclosed in Federal Republic of Germany application No. G 90 01 479.0, filed on Feb. 9, 1990, the disclosure of which is incorporated herein by reference.

While the description above refers to particular embodiments of the present invention, it will be understood that many modifications may be made without departing from the spirit thereof. The accompanying claims are intended to cover such modifications as would fall withing the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. In combination with a protective suit having a crotch, a longitudinally adjustable support belt removably connectable to the crotch of the protective suit in such a way that when the suit is being worn said belt extends essentially vertically between the protective suit and the wearer and envelops the body of the wearer; wherein said support belt comprises: a central part having two opposed ends and located to pass across the crotch area of the wearer; a first V-shaped end section located to pass over the shoulders of the wearer; and a second V-shaped end section located to be fastened to said first end section; and wherein each said end section is connected to a respective end of said central part.

2. A protective suit in accordance with claim 1 wherein said belt further comprises fastening means carried by said end sections for fastening said end sections together in the chest area of the wearer when said belt is being worn.

3. A protective suit in accordance with claim 2 wherein said fastening means comprise hook-and-loop fasteners composed of two fastening parts, each of said fastening parts being secured to a respective one of said end sections.

4. A protective suit in accordance with claim 1 wherein said belt further comprises two connector members each disposed at a respective end of said central part and each securing a respective end section to said central part.

5. A protective suit in accordance with claim 1 wherein said central part and each said end section are composed of plastic fabric bands each having a width of approximately 50 mm and a thickness of approximately 1.5 mm.

6. A protective suit in accordance with claim 1 wherein each said end section comprises two bands joined together at a respective end of said central part.

* * * * *